United States Patent [19]

Smith et al.

[11] Patent Number: 4,487,743

[45] Date of Patent: Dec. 11, 1984

[54] CONTROLLED EXPANSION ALLOY

[75] Inventors: John S. Smith, Proctorville, Ohio; Darrell F. Smith, Jr., Huntington, W. Va.

[73] Assignee: Huntington Alloys, Inc., Huntington, W. Va.

[21] Appl. No.: 409,838

[22] Filed: Aug. 20, 1982

[51] Int. Cl.[3] ..... C22C 19/03

[52] U.S. Cl. ..... 420/459; 420/581; 420/582; 420/584; 420/586

[58] Field of Search ..... 420/459, 443, 447, 448, 420/451, 458, 581, 582, 584, 586; 148/409, 410, 419, 426, 427, 428, 429, 442

[56] References Cited

U.S. PATENT DOCUMENTS

| | | | |
|---|---|---|---|
| 2,994,605 | 8/1961 | Gill et al. | 75/171 |
| 3,046,108 | 7/1962 | Eiselstein | 75/171 |
| 3,157,495 | 11/1964 | Eiselstein et al. | 75/134 |
| 3,705,827 | 12/1972 | Muzyka et al. | 148/142 |
| 3,971,677 | 7/1976 | Mason et al. | 148/31 |
| 3,972,752 | 8/1976 | Honnorat et al. | 148/162 |
| 4,006,011 | 2/1977 | Muzyka et al. | 75/122 |
| 4,026,699 | 5/1977 | Eiselstein et al. | 75/134 F |
| 4,066,447 | 1/1978 | Smith et al. | 75/122 |
| 4,200,459 | 4/1980 | Smith, Jr. et al. | 420/459 |

FOREIGN PATENT DOCUMENTS

| | | |
|---|---|---|
| EP-A-0056480 | 12/1981 | European Pat. Off. . |
| 2228117 | 10/1974 | France . |
| 2411246 | 6/1979 | France . |
| 999439 | 7/1965 | United Kingdom . |
| 1083432 | 9/1967 | United Kingdom . |
| 1411693 | 5/1974 | United Kingdom . |

*Primary Examiner*—R. Dean

*Attorney, Agent, or Firm*—Raymond J. Kenny

[57] ABSTRACT

In an age hardenable controlled expansion alloy essentially devoid of chromium, the combination of short term tensile properties and elevated temperature properties, particularly notch rupture strength, are improved by the inclusion therein of silicon in an amount leass than 1%.

7 Claims, No Drawings

CONTROLLED EXPANSION ALLOY

BACKGROUND OF THE INVENTION AND THE PRIOR ART

Nickel-iron alloys and nickel-cobalt-iron alloys of controlled composition have long been known and used in applications in which controlled, low expansion characteristics are desired. The Eiselstein et al. U.S. Pat. No. 3,157,495 introduced to the art age-hardenable, controlled expansion alloys having high strength at room temperature and at elevated temperatures. The availability of such alloys caught the attention of gas turbine engine builders, particularly those building aircraft engines. Due to the requirements for strength, ability to resist loads for long times at elevated temperature, notch resistance, etc. imposed by the engine builders in respect of parts to be used in engines, extensive testing was conducted upon the alloys provided in accordance with U.S. Pat. No. 3,157,495 and certain deficiencies in properties were noted. A divergence of views has arisen as to how such deficiencies should be remedied. A succession of patents directed to modifications of the alloys has resulted, of which U.S. Pat. Nos. 3,705,827, 4,006,011, 4,026,699, 4,066,447 and 4,200,459 can be mentioned. U.S. Pat. No. 3,971,677 and U.K. Pat. No. 1,411,693, which are directed to cast products, can also be mentioned. Testing programs have revealed that the failure mechanism encountered in notched specimens in these essentially chromium-free alloys is that of stress-corrosion due to oxidation or oxygen embrittlement. Thus, alloys which have poor notch strength in air have excellent notch strength when tested in vacuum. It has also been observed that, due to relaxation effects, stress-rupture ductility and notch resistance in some alloys may be satisfactory at temperatures on the order of 1200° F. or 1300° F., but inadequate at 1000° F.

Previous high aluminum, controlled expansion alloys had significant shortcomings of notch-rupture strength, especially when testing recrystallized grain structures or when thermomechanically processed structures were tested transverse to the direction of work. Such alloys showed 100 hr. notch strength of only about 50 Ksi (1 Ksi = 1,000 pounds per square inch) or less at 1000° F.

It is desirable to improve such 100 hr. notch-rupture strength of controlled expansion alloys to at least 100 ksi. Further, it is sometimes advantageous for controlled expansion alloys to exhibit notch ductile behavior; i.e., where notch bar rupture life exceeds smooth bar rupture life.

It is known that the aging treatments designed to produce required properties in these age-hardenable alloys will vary depending upon the properties to be emphasized. Thus, heat treatments designed to maximize elevated temperature strength and notch strength are generally longer and at higher temperatures than those designed to maximize short-term strength and the former are, in fact, overaging treatments. For example, in the low-aluminum alloys described in U.S. Pat. No. 4,200,459 it is now known that such overaging treatments are necessary to develop good notch rupture strength at 1000° F. It has become desirable to increase the short-term tensile properties of low Al controlled COE alloys while retaining the good rupture strength previously attained only by overaging.

Economic pressure has introduced a need to shorten overall heat treating times. In addition, there is a need to provide alloys which exhibit good notch strength after exposure to high solution treating temperature which may, for some purposes such as brazing, be 1900° F. or higher.

It is to the solution of these and other problems that the present invention is directed.

SUMMARY OF THE INVENTION

Controlled expansion, nickel-iron and nickel-cobalt-iron age-hardenable alloys demonstrate an improved combination of short-term tensile properties and stress-rupture notch strength when the aluminum content is limited to a maximum of about 0.2% and the silicon content is about 0.25% to about 1%.

DETAILED DESCRIPTION OF THE INVENTION

The invention is directed to age-hardenable alloys containing about 34% to 55% nickel, up to about 25% cobalt, about 1% to about 2% titanium, about 1.5% to about 5.5% columbium, about 0.25% to about 1% silicon, not more than about 0.2% aluminum, not more than 0.1% carbon, and the balance essentially iron. The alloy compositions, herein expressed in weight percent, are correlated in terms of the significant elements such that the inflection temperature will be at least 625° F., and the coefficient of expansion measured at temperatures between ordinary ambient and the inflection temperature will be $5.5\times10^{-6}$ per °F. or lower. The age hardened alloys are strong, e.g., will have a room temperature yield strength (0.2% offset) of at least about 115,000 pounds per square inch (psi) and a notch bar rupture life of at least 60. hours when tested at 1000° F. and 120. Ksi. Except where otherwise noted, the stress concentration factor ($K_t$) of the noted specimen is equal to 2. In the overaged condition, alloys in accordance with the invention may be notch ductile at 1000° F., and display a rupture life at 120 ksi well in excess of 100 hours. Even in the overaged condition alloys of the invention display high yield strength at ambient temperatures and at elevated temperatures, e.g., 1000° F. For example, overaged ambient temperature yield strengths of 100,000 psi or higher are obtained.

Preferably, alloys of the invention contain about 35% to about 39% nickel, about 12% to about 16% cobalt, about 1.2% to about 1.8% titanium, about 4.3% to about 5.2% columbium, about 0.3% to about 0.5% silicon, not more than about 0.1% aluminum and the balance essentially iron.

Alloys of the invention may contain small amounts of impurities and incidental elements such as up to about 0.01% calcium, up to about 0.01% magnesium, up to about 0.03% boron, up to about 0.1% zirconium, up to about 1% each of copper, molybdenum, chromium, tungsten and manganese, not over 0.015% of sulfur or phosphorous, etc. It will be appreciated that a small amount of tantalum, e.g., about 0.1% to 10% of the columbium content, will be present unavoidably in most commercial columbium sources. For purposes of the invention, tantalum acts as columbium, but since the atomic weight of tantalum is twice that of columbium, the weight percent of tantalum present is divided by two. Thus, "columbium" herein means columbium plus half the tantalum present. While, as noted, small amounts of boron may be present in the alloy, mounting experimental evidence indicates that boron is unnecessary for any important metallurgical purpose.

The presence of a controlled amount of silicon along with aluminum less than about 0.1% provides substantial improvements in properties of the age hardened alloys and appears also to improve the kinetics of heat treatment thereby permitting the use of shorter heat treating times.

It has been determined that Inflection Temperature (IT) and Coefficient of Expansion (COE) can be approximated from composition using the following formulae:

$$COE = -8.698 + 1.888(\%C) + 0.367(\%Mn + \%Cu) + 0.145(\%Si + \%Cr) + 0.2683(\%Ni) + 0.2481(\%CO) - 0.392(\%Ti).$$

$$IT = -804.4 + 306.7(\%C) - 39.8(\%Si + \%Cr) + 32.8(\%Ni) + 31.9(\%Co) - 37.8(\%Ti).$$

Thus to guarantee an IT of at least 625° F. and a COE no greater than $5.5 \times 10^{-6}$ per °F. measured at 780° F. from ambient temperature the composition of the alloys of the invention must be restricted by the following relationships:

$$A = (\%Ni) + 0.93(\%Co) - 1.46(\%Ti) + 0.54(\%Si + \%Cr) + 1.37(\%Mn + \%Cu) + 7.04(\%C) \quad \text{At most } 52.9$$

$$B = (\%Ni) + 0.97(\%Co) - 1.15(\%Ti) - 1.21(\%Si + \%Cr) + 9.35(\%C) \quad \text{A least } 43.6$$

Some examples will now be given:

EXAMPLE 1

A series of 14 kilogram heats was prepared, the compositions of which are set forth in Table 1.

The ingots of Alloys 1 through 5 were forged and rolled to flats. The tensile properties at room temperature obtained after annealing at 1700° F., 1800° F. and 1900° F. and aging are given in Table 2, while the tensile properties obtained at 1000° F. on the same alloys similarly heat treated are given in Table 4.

Smooth and notch bar stress rupture properties were determined on Alloys 1 through 5 at 1000° F. and 120 ksi after anneals at 1700° F., 1800° F. and 1900° F. and aging, and are given in Tables 5 and 6, respectively. Aging conditions are given in the Tables. Coefficients of Expansion (COE) and Inflection Temperature (IT) both observed and as predicted by the formulae given hereinbefore are set forth in Table 10.

Alloys 6 through 13 were forged and hot rolled to rounds. The tensile properties at room temperature obtained on Alloys 6 through 9, 11 and 12 are given in Table 3. Heat treatments include annealing at 1800° F. and 1900° F., and aging and overaging with 1325° F. and 1425° F. stepdown heat treatments.

Smooth and notch bar rupture data at 1000° F. was obtained on Alloys 6 through 9, 11 and 12 after heat treating as above. Smooth bar data is presented in Table 7 and notch bar data in Table 8. COE and IT both observed and predicted by the formulae given herein before are set forth in Table 10.

EXAMPLE 2

A commercial heat was prepared by vacuum induction melting and arc remelting. The heat contained 38.46% nickel, 13.36% cobalt, 4.79% columbium, 1.57% titanium, 0.05% aluminum, 0.39% silicon, 0.01% carbon, 0.12% chromium, 0.12% molybdenum, 0.0013% boron, 0.24% copper, 0.04% manganese, 0.001% sulfur, balance iron. The 20 inch diameter ingot was cogged to 8"×12" and a slice cut from the end of the cog revealed no segregation. Tensile and rupture properties obtained on this heat are given in Table 9.

The data in Tables 2 and 4 demonstrate the silicon containing alloys have good short term tensile properties at room and elevated temperature, while the data in Tables 5 and 6 demonstrate that increasing silicon improves notch rupture strength and smooth rupture ductility. Depending on the application requirements, silicon content can be selected to give a desired balance between smooth bar strength and ductility. Silicon contents from about 0.3% to less than about 0.7% give outstanding smooth and notch bar rupture strength with useful smooth bar ductility. Higher silicon levels could find applications where excellent smooth bar ductility and notch rupture strength are desired.

The data in Table 3 show very high tensile properties in alloys in the aged condition, i.e., 1325° F., containing about 1.5% titanium.

Smooth rupture data presented in Table 7 and notch rupture data in Table 8 give further support of the beneficial effects to rupture life in aged alloys with silicon contents above about 0.3%.

Also for other applications where rupture ductility is emphasized over rupture life, overaging heat treatments such as the two-step 1425° F. treatment may be utilized, resulting in excellent smooth rupture ductility with notch ductile behavior. Such overaging heat treatments could be particularly beneficial where high solution treating temperatures such as 1900° F. are desirable.

Thus these data indicate that there are numerous combinations of silicon and aging heat treatments to achieve desired properties.

The data in Tables 7 and 8 also show that carbon contents in excess of about 0.1% are detrimental to rupture life and ductility.

The results shown in Table 10 demonstrate that the IT and COE formulae given herein are accurate up to a silicon content of 0.89%. It will be appreciated that these relationships of ingredients are quite restrictive in terms of providing alloys having a maximum COE of not more than $5.5 \times 10^{-6}$ per °F. along with an IT of at least 625° F. Preferably the COE is not greater than $4.5 \times 10^{-6}$ per °F. and the IT is at least 750° F. These requirements place tight restraints upon the alloy chemistry as described by the following relationships:

$$A = (\%Ni) + 0.92(\%Co) - 1.46(\%Ti) + 0.54(\%Si + \%Cr) + 1.37(\%Mn + \%Cu) + 7.04(\%C) \quad \text{at most } 49.2$$

$$B = (\%Ni) + 0.97(\%Co) - 1.15(\%Ti) - 1.21(\%Si + \%Cr) + 9.35(\%C) \quad \text{at least } 47.4$$

The data in Table 9 demonstrate that the properties of forged and hot rolled bars produced from a commercial scale heat also show an excellent combination of short-term tensile properties and rupture behavior with the preferred COE and IT properties.

The reasons for the significant effects of small amounts of silicon upon the properties of alloys of the invention are not fully understood. It appears at present that silicon contributes to production of a precipitated phase in the form of discrete fine particulates and improves resistance of the alloy to stress accelerated oxygen embrittlement without requiring the extreme overaging and associated needle and platelet phases necessary in the overaged low Al alloy.

While the alloy has been illustrated herein in terms of the properties of wrought products, useful properties are also obtained in cast products made therefrom. It is also to be appreciated that useful alloys can be produced which contain no cobalt.

As noted hereinbefore, the aluminum content of the alloys is kept low, e.g., not over 0.2%, in order to realize the benefits conferred by the small, controlled silicon contents contemplated by the invention. This is illustrated by laboratory Alloys A and B, outside the invention, the compositions of which are given in Table 11, and the stress-rupture properties (at 1200° F.) of which are given in Table 12.

The results of Table 12 demonstrate that these alloys are notch sensitive even though the tests were annealed at the less critical anneal of 1700° F. and were conducted at 1200° F., a temperature found to be less notch sensitive than the 1000° F. temperature used in testing alloys of the invention. Alloys 6 and 9, included for comparison, again exhibit the benefit of Si in low aluminum alloys.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

TABLE 1

| Alloy No. | CHEMICAL ANALYSIS, WT. % C | Mn | Fe | S | Si | Cu | Ni | Cr | Al | Ti | Co | Mo | Cb + Ta | B |
|---|---|---|---|---|---|---|---|---|---|---|---|---|---|---|
| 1 | .013 | .13 | Bal | .002 | .12 | .19 | 38.30 | .90 | .02 | 1.47 | 12.47 | .09 | 4.67 | (a) |
| 2 | .003 | .11 | " | .002 | .29 | .13 | 38.48 | .38 | .075 | 1.22 | 12.87 | .03 | 4.79 | (a) |
| 3 | .032 | .11 | " | .003 | .51 | .11 | 38.24 | .11 | .07 | 1.23 | 12.93 | .01 | 4.79 | (a) |
| 4 | .004 | .10 | " | .002 | .70 | .10 | 38.45 | .04 | .065 | 1.24 | 13.00 | .001 | 4.83 | (a) |
| 5 | .003 | .14 | " | .002 | .89 | .13 | 38.39 | .15 | .003 | 1.37 | 13.00 | .004 | 4.79 | (a) |
| 6 | .03 | .11 | " | .002 | .10 | .10 | 38.14 | .04 | .05 | 1.53 | 13.86 | .01 | 4.82 | .001 |
| 7 | .02 | .11 | " | .002 | .20 | .11 | 38.12 | .03 | .05 | 1.53 | 13.90 | (a) | 4.81 | .001 |
| 8 | .03 | .10 | " | .002 | .35 | .11 | 38.14 | .06 | .07 | 1.48 | 14.01 | .01 | 4.81 | .001 |
| 9 | .01 | .12 | " | .003 | .50 | .12 | 38.05 | .01 | .10 | 1.53 | 13.81 | .01 | 4.91 | .001 |
| 10 | .01 | .11 | " | .003 | .51 | .42 | 38.08 | .01 | .12 | 1.56 | 13.81 | .01 | 4.92 | .001 |
| 11 | .11 | .11 | " | .003 | .13 | .10 | 37.89 | .01 | .10 | 1.61 | 13.71 | (a) | 4.94 | .001 |
| 12 | .11 | .12 | " | .002 | .54 | .12 | 38.06 | .01 | .10 | 1.65 | 13.81 | .01 | 4.91 | .001 |
| 13 | .13 | .11 | " | .003 | .51 | .43 | 38.05 | .01 | .12 | 1.57 | 13.79 | .01 | 4.95 | .001 |

NOTE:
(a) None added, not analyzed.
All numbers shown as .001 analyze less than .001.

TABLE 2

ROOM TEMPERATURE TENSILE PROPERTIES
.562" × 3.5" Hot Rolled Flat

| Alloy No. | Si Wt. % | As Rolled YS ksi | TS ksi | EL % | RA % | 1700° F./1325° YS ksi | TS ksi | EL % | RA % | 1800° F./1325° YS ksi | TS ksi | EL % | RA % | 1900° F./1325° YS ksi | TS ksi | EL % | RA % |
|---|---|---|---|---|---|---|---|---|---|---|---|---|---|---|---|---|---|
| 1 | .12 | 99.5 | 134.6 | 27.1 | 48.3 | 145.1 | 187.2 | 12.1 | 20.5 | 149.5 | 192.3 | 15.0 | 31.7 | 143.5 | 187.1 | 15.0 | 25.0 |
| 2 | .29 | 87.8 | 124.1 | 30.0 | 44.5 | 137.6 | 176.3 | 10.7 | 15.5 | 138.4 | 182.0 | 12.8 | 31.4 | 135.7 | 176.8 | 11.4 | 21.4 |
| 3 | .51 | 99.4 | 132.2 | 21.4 | 32.2 | 129.3 | 169.4 | 9.2 | 10.8 | 133.3 | 177.8 | 12.8 | 19.4 | 129.6 | 175.3 | 15.0 | 23.8 |
| 4 | .70 | 90.7 | 125.3 | 18.5 | 25.3 | 123.9 | 164.2 | 7.1 | 9.7 | 126.2 | 168.2 | 8.5 | 11.7 | 131.0 | 175.8 | 10.7 | 15.5 |
| 5 | .89 | 103.8 | 139.5 | 16.0 | 26.4 | 118.8 | 158.2 | 5.7 | 8.6 | 124.8 | 166.8 | 11.4 | 19.7 | 129.2 | 173.9 | 8.5 | 13.7 |

NOTES:
1. Heat Treatments: Annealed as shown for one hr, air cooled (AC) + Aged 1325° F./8 hr/FC 100° F. per hr 1150° F./8 hr/AC.
2. Hot Working procedure: 1. Nominal start size = 1⅛" thick × 3½" wide × length flat. 2. Hot Rolled at 1950° F. to ¾" × 3½" (32%). 3. Reheated to 1700° F. 4. Hot rolled to 9/16" × 3½" × length (25%).
3. Long transverse orientation.

TABLE 3

ROOM TEMPERATURE TENSILE PROPERTIES
9/16" Diameter Hot Rolled Rounds

| Alloy No. | Si Wt % | C | 1800°/1325° YS ksi | TS ksi | EL % | RA % | 1800°/1425° YS ksi | TS ksi | EL % | TA % | 1900°/1325° YS ksi | TS ksi | EL % | RA % |
|---|---|---|---|---|---|---|---|---|---|---|---|---|---|---|
| 6 | .10 | .03 | 159.8 | 198.8 | 15. | 32.6 | 122.6 | 176.3 | 15.0 | 19.3 | 156.8 | 196.3 | 13.5 | 31.1 |
| 7 | .20 | .02 | 155.7 | 199.8 | 14.2 | 32.3 | 117.3 | 171.0 | 16.4 | 21.8 | | | | |
| 9 | .50 | .01 | 154.3 | 195.8 | 15.7 | 37.1 | 114.1 | 166.2 | 15.7 | 26.0 | 154.6 | 193.7 | 12.8 | 22.3 |
| 11 | .13 | .11 | 161.5 | 201.0 | 14.2 | 32.2 | 123.3 | 174.7 | 17.1 | 24.4 | | | | |
| 12 | .54 | .11 | 149.4 | 192.2 | 12.8 | 28.8 | 114.0 | 162.9 | 14.2 | 21.1 | | | | |

NOTES:
1. Heat Treatments: Annealed as shown for one hr, Air Cooled plus Aged, 1325° (or 1425°)F./8 hr FC 100° F. per hr 1150° F./8 hr, AC
2. Hot Working Procedure: 1. Forged from 1½" Sq. to ¾" Sq. at 2050° F. 2. Heated at 1900° F. 3. Hot Rolled to 9/16" Diameter Round.
3. Longitudinal.

TABLE 4

1000° F. TENSILE PROPERTIES
.562" × 3.5" Hot Rolled Flat
Long Transverse

| Alloy No. | Si Wt % | 1700°/1325° YS ksi | TS ksi | EL % | RA % | 1800°/1325° YS ksi | TS ksi | EL % | RA % | 1900°/1325° YS ksi | TS ksi | EL % | RA % |
|---|---|---|---|---|---|---|---|---|---|---|---|---|---|
| 1 | .12 | 115.3 | 146.0 | 13.0 | 44.5 | 126.5 | 158.9 | 14.6 | 39.0 | 125.1 | 156.1 | 15.2 | 40.9 |
| 2 | .29 | 119.2 | 146.3 | 12.1 | 42.7 | 112.6 | 149.7 | 13.2 | 37.0 | 114.8 | 145.3 | 13.2 | 35.2 |
| 3 | .51 | 115.6 | 145.3 | 11.0 | 25.0 | 109.8 | 147.3 | 12.0 | 29.0 | 111.1 | 150.2 | 13.3 | 33.4 |
| 4 | .70 | 106.1 | 141.1 | 10.9 | 24.4 | 99.4 | 142.0 | 11.0 | 21.5 | 107.3 | 149.2 | 10.9 | 20.6 |
| 5 | .89 | 102.1 | 138.8 | 13.5 | 31.1 | 99.1 | 140.7 | 12.2 | 29.1 | 106.6 | 141.3 | 13.6 | 30.0 |

NOTE:
1. Annealed as shown for one hour, air cooled + 1325° F./8 hr FC 100° F. per hr to 1150° F./8 hr, AC.

TABLE 5

1000° F./120 ksi SMOOTH BAR RUPTURE PROPERTIES
.562" × 3.5" Hot Rolled Flat
Long Transverse

| Alloy No. | Si Wt % | 1700° F./1325° F. Life hr | EL % | RA % | Final Stress ksi | 1800° F./1325° F. Life hr | EL % | RA % | Final Stress ksi | 1900° F./1325° F. Life hr | EL % | RA % | Final Stress ksi |
|---|---|---|---|---|---|---|---|---|---|---|---|---|---|
| 1 | .12 | 184.2 | 8.0 | 19.8 | 145. | 24.8 | (4) | 4.4 | 120. | 13.8 | 2.0 | 6.1 | 120. |
| 2 | .29 | 175.5 | 3.5 | 9.3 | 145. | 146.6 | 2.9 | 10.8 | 135. | 25.4 | 1.9 | 6.8 | 120. |
| 3 | .51 | 138.2 | 5.0 | 8.0 | 130. | 122.0 | 2.0 | 4.7 | 125. | 120.1 | 2.0 | 4.9 | 125. |
| 4 | .70 | 5.7 | 12.2 | 15.2 | 120. | 8.5 | 10.1 | 9.5 | 120. | 41.1 | 3.2 | 7.7 | 120. |
| 5 | .89 | 0.5 | 18.3 | 29.3 | 120. | 3.0 | 17.7 | 23.0 | 120. | 16.7 | 11.5 | 17.7 | 120. |

NOTES:
1. Heat Treatments: Annealed as shown one hour, AC + Aged as shown 8 hours, furnace cooled 100° F. per hour to 1150° F. for 8 hours, AC.
2. Tested at 1000° F./120. Ksi, stress increased 5 Ksi each 8 to 16 hours after 120. hours in test.
3. See Table 2 for hot working procedure.
4. Fractured outside gage marks.

TABLE 6

1000° F./120 ksi NOTCH BAR RUPTURE PROPERTIES
.562" × 3.5" Hot Rolled Flat
Long Transverse

| Alloy No. | Si Wt % | 1700° F./1325° F.[4] Life hr | EL % | RA % | Final Stress ksi | 1800° F./1325° F.[5] Life hr | Failure | Final Stress ksi | 1900° F./1325° F.[5] Life hr | Failure | Final Stress ksi |
|---|---|---|---|---|---|---|---|---|---|---|---|
| 1 | .12 | 186.3 | 3.4 | 4.0 | 150. | 7.1 | Notch | 120. | 5.9 | Notch | 120. |
| 2 | .29 | 166.3 | 4.7 | 7.3 | 140. | 34.5 | Notch | 120. | 15.5 | Notch | 120. |
| 3 | .51 | 89.9 | 6.9 | 10.5 | 120. | 104.0 | Notch | 120. | 85.1 | Notch | 120. |
| 4 | .70 | 7.9 | 12.0 | 19.5 | 120. | 163.5 | Shank[6] | 145. | 135.8 | Notch | 130. |
| 5 | .89 | 2.6 | 16.5 | 25.9 | 120. | 177.6 | Shank[6] | 150. | 160.0 | Notch | 140. |

NOTES:
[1]Heat Treatments: Annealed as shown one hour, AC + Aged as shown 8 hours, furnace cooled 100° F. per hour to 1150° F. for 8 hours, AC.
[2]Tested at 1000° F./120. Ksi, stress increased 5 Ksi each 8 to 16 hours after 120. hours in test.
[3]See Table 2 for hot working procedure.
[4]Specimen: $K_t$ 3.6 combination notch bar.
[5]Specimen: $K_t$ 2.0 double shank notch bar.
[6]Shank-indicates failure in smooth ligament, stress approximately 86% of stress on notch (shown).

TABLE 7

1000° F./120 Ksi SMOOTH BAR RUPTURE PROPERTIES
9/16" Diameter Hot Rolled Round
Longitudinal

| Alloy No. | Si Wt % | C Wt % | 1800°/1325° Life Hrs | EL % | RA % | 1800°/1425° Life Hrs | EL % | RA % | 1900°/1325° Life Hrs | EL % | RA % |
|---|---|---|---|---|---|---|---|---|---|---|---|
| 6 | .10 | .03 | 48.6 | 3.3 | 7.7 | 703.5 | 3.2 | 9.3 | 26.1 | 2.7 | 9.5 |
| 7 | .20 | .02 | 45.6 | 2.3 | 6.1 | 1066.5 | 3.6 | 3.5 | | | |
| 8 | .35 | .03 | 1392.2 | 2.4 | 6.2 | 31.0 | 14.7 | 33.6 | | | |
| 9 | .50 | .01 | 1002.6 | 9.9 | 15.1 | 5.8 | 21.8 | 47.4 | 447.1 | 2.5 | 2.0 |
| 11 | .13 | .11 | 24.0 | 1.1 | 2.0 | 712.4 | 1.5 | 4.3 | | | |
| 12 | .54 | .11 | 726.9 | 1.7 | 4.0 | 16.4 | 10.1 | 30.5 | | | |

NOTES:
1. Heat Treatments: Annealed as shown for one hour. Air Cooled plus Aged 1325° (or 1425°)F./8 hr FC 100° F. per hr to 1150° F./8 hr, AC.
2. Hot Working Procedure: See Footnote - Table 3.

TABLE 8

1000° F./120 Ksi Kt 7 2 NOTCH BAR RUPTURE PROPERTIES
9/16 " Diameter Hot Rolled Round
Longitudinal

| Alloy No. | Si Wt % | C Wt % | 1800°/1325° Life Hrs | Failure | Final Stress Ksi | 1800°/1425° Life Hrs | Failure | Final Stress Ksi | 1900°/1325° Life Hrs | Failure | Final Stress Ksi |
|---|---|---|---|---|---|---|---|---|---|---|---|
| 6 | .10 | .03 | 12.0 | Notch | 120 | 186.4 | Notch | 150 | 9.3 | Notch | 120 |
| 7 | .20 | .02 | 16.9 | Notch | 120 | 210.2 | Shank[4] | 155 | | | |
| 8 | .35 | .03 | 164.8 | Notch | 140 | 180.7 | Shank[(4)] | 145 | | | |
| 9 | .50 | .01 | 615.9 | Shank[4] | 155 | 164.8 | Shank[4] | 140 | 20.4 | Notch | 120 |
| 11 | .13 | .11 | 12.8 | Notch | 120 | 167.5 | Notch | 140 | | | |
| 12 | .54 | .11 | 51.7 | Notch | 120 | 202.5 | Shank[4] | 155 | | | |

NOTES:
[1]Heat Treatments: Annealed as shown for one hr, Air Cooled plus Aged 1325° (or 1425°)F./8 hr FC 100° F. per hr to 1150° F./8 hr, AC.
[2]Hot Working Procedure: See Footnote - Table 3.
[3]Tested at 1000° F./120 Ksi Stress increased 5 Ksi each 8 to 16 hrs after 120 hrs in test.
[4]Shank-Indicates failure in smooth ligament, stress approximately 86% of stress on notch (shown).

TABLE 9

COMMERCIAL HEAT EVALUATION
Y88B7

I. Forged 1" Square Bar

Heat Treatment: 1800° F./1 hr, AC + 1325° F./8 hr, FC 100° per hr, to 1150° F./8 hr, AC.

| 1. Tensile Properties: | RTT | 1000° F. HTT |
|---|---|---|
| Hardness | 41.$R_c$ | — |
| Yield | 147.6 ksi | 126.2 ksi |
| Tensile | 188.9 ksi | 165.3 ksi |
| Elongation | 11.0% | 15% |
| Reduction of Area | 25.0% | 45.9% |

| 2. Rupture Properties: | Smooth | $K_t$ 2.0 Notch | $K_t$ 3.6 Combination |
|---|---|---|---|
| Life | 183.5 hr | 712.7 hr | 221.4 hr |
| Final Stress | 145. ksi | 165. ksi | 150. ksi |
| Elongation | 15.2% | | 10.0% |
| Reduction of Area | 47.9% | Shank[3] | 24.5% |

3. Expansion Properties: COE at 780° F. = 4.41 × $10^{-6}$ per °F.

TABLE 9-continued

COMMERCIAL HEAT EVALUATION
Y88B7

| | | |
|---|---|---|
| Tensile | | 199.3 ksi |
| Elongation | | 15.0% |
| Reduction of Area | | 31.3% |
| 2. Rupture Properties: | Smooth Bar | $K_t$ 2.0 Notch |
| Life | 159.8 hr | 140.2 hr |
| Final Stress | 140.0 ksi | 130.0 ksi |
| Elongation | [4] | Notch |
| Reduction of Area | [4] | |

NOTES:
Composition in text.
[1]Rupture tests conducted at 1000° F./120. ksi for 120. hr then stress increased 5. ksi each 8 to 16 hr.
[2]All notches ground.
[3]Shank-Indicates failure occurred in smooth ligament portion of specimen, stress approximately 86% of notch stress (shown).
[4]Fractured in fillet outside punched gage marks.

TABLE 10

THERMAL EXPANSION CHARACTERISTICS

| Heat No. | Si Wt % | 780° F. COE, $10^{-6}$ per °F. Observed | Predicted | Inflection Temp., °F. Observed | Predicted | Heat Treatment[1] Ann./Age, °F. |
|---|---|---|---|---|---|---|
| 6 | .10 | 4.35[2] | 4.42 | 807.[2] | 817. | 1900/1425, 1700/1425 |
| 1 | .12 | 4.38 | 4.28 | 770. | 744. | 1800/1325 |
| 8 | .35 | 4.52[2] | 4.50 | 799.[2] | 812. | 1900/1425, 1700/1425 |
| 9 | .50 | 4.40 | 4.39 | 786. | 796. | 1900/1425/1325 |
| 2 | .29 | 4.49 | 4.42 | 784. | 786. | 1800/1325 |
| 3 | .51 | 4.42 | 4.39 | 788. | 782. | 1800/1325 |
| 4 | .70 | 4.45 | 4.48 | 789. | 786. | 1800/1325 |
| 5 | .89 | 4.46 | 4.48 | 790. | 767. | 1800/1325 |
| 10 | .51 | 4.53 | 4.49 | 798. | 796. | 1900/1425/1325 |
| 12 | .54 | 4.53 | 4.54 | 810. | 816. | 1900/1425/1325 |
| 13 | .51 | 4.66 | 4.70 | 823. | 825. | 1900/1425/1325 |
| Y88B7 | .39 | 4.41 | 4.40 | 790. | 794. | 1800/1325 |

NOTES:
[1]Heat Treatments:
1900/1425/1325 = 1900° F./1 hr, AC + 1425° F./24 hr, AC + 1325° F./8 hr FC 100° F./hr to 1150° F./8 hr, AC.
1900/1425 = 1900° F./1 hr, AC + 1425° F./8 hr FC 100° F./hr to 1150° F./8 hr, AC.
1800/1325 = 1800° F./1 hr, AC + 1325° F./8 hr FC 100° F./hr to 1150° F./8 hr, AC.
1700/1425 = 1700° F./1 hr, AC + 1425° F./8 hr FC 100° F./hr to 1150° F./8 hr, AC.
[2]Average of two tests.
[3]Reference temperature = 77° F.
[4]COE data quartz corrected.

(77° F. reference)
Inflection temperature = 790° F.

II. Hot Rolled .562" Diameter Bar

Heat Treatment: 1800° F./1 hr, AC + 1325° F./8 hr FC 100° per hr to 1150° F./8 hr, AC.

| 1. Tensile Properties: | RTT |
|---|---|
| Hardness | 42.5 $R_c$ |
| Yield | 158.2 ksi |

TABLE 11

(COMPOSITION)

| Alloy No. | % Fe | % Ni | % Al | % Ti | % Co | % Cb | % Si |
|---|---|---|---|---|---|---|---|
| A | 40.8 | 38.2 | 0.97 | 1.46 | 15.4 | 3.1 | 0.45 |
| B | Bal | 37.72 | 0.46 | 1.34 | 14.64 | 3.24 | 0.34 |

TABLE 12

| 1200° F. COMBINATION SMOOTH AND $K_t$ = 3.6 NOTCH BAR RUPTURE PROPERTIES | | | | | | | | |
|---|---|---|---|---|---|---|---|---|
| Alloy No. | Al Wt % | Si Wt % | Heat Treatment[2] | Stress Ksi | Life Hrs Notch | Life Hrs Smooth | EL % | RA % |
| 6 | .05 | .10 | 1800° F./1 Hr, AC + 1325° | 85 | 54.3 | Notch | Failure | |
| A | .97 | .45 | 1700° F./1 Hr, WQ + 1325° | 70 | 3.9 | Notch | Failure | |
| B | .46 | .34 | 1700° F./1 Hr, WQ + 1325° | 70 | 3.0 | Notch | Failure | |
| 9 | .10 | .50 | 1800° F./1 Hr, AC + 1325° | 85 | 39.3 | 39.3 | 21.6 | 51.6 |

NOTES:
[1]Alloys 6 and 9 were 9/16" diameter hot rolled round. Alloys A and B were 9/16" forged square bars.
[2]Aging Treatment 1325° F./8 hr FC 100° F./hr 1150° F./8 hr, AC.
WQ = Water Quenched.

The embodiments of the invention in which an exclusive property or privilege is claimed are defined as follows:

1. An age hardenable alloy characterized by controlled expansion properties with an inflection temperature of at least 625.° F. and a coefficient of expansion between ambient and inflection temperatures of $5.5\times10^{-6}$ per °F. or less, high strength and good notch rupture strength consisting essentially of about 34% to 55% nickel, up to about 25% cobalt, about 1% to 2% titanium, about 1.5% to 5.5% columbium, about 0.25% to 1% silicon, not more than about 0.2% aluminum, not more than about 0.1% carbon and the balance essentially iron.

2. An alloy in accordance with claim 1 having an inflection temperature of at least about 750° F. and a coefficient of expansion at temperatures between ambient and the inflection temperature of $4.5\times10^{-6}$ per °F. or lower.

3. An alloy in accordance with claim 1 containing about 35% to 39% nickel, about 12% to 16% cobalt, about 0.3% to 0.5% silicon, not more than about 0.1% aluminum, about 1.2% to 1.8% titanium, about 4.3% to 5.2% columbium and the balance essentially iron.

4. An alloy in accordance with either of claims 1 or 3 having the ingredients thereof controlled in accordance with the relationships:

$$COE=-8.698+1.888(\%C)+0.367(\%Mn+\%Cu)+0.145(\%Si+\%Cr)+0.2683(\%Ni)+0.2481(\%Co)-0.392(\%Ti)$$

$$IT=-804.4+306.7(\%C)-39.8(\%Si+\%Cr)+32.8(\%Ni)+31.9(\%Co)-37.8(\%Ti).$$

5. An alloy in accordance with either claims 1 or 3 having the ingredients thereof controlled in accordance with the relationships:

$$A=(\%Ni)+0.93(\%Co)-1.46(\%Ti)+0.54(\%Si+\%Cr)+1.37(\%Mn+\%Cu)+7.04(\%C) \text{ at most } 52.9$$

$$B=(\%Ni)+0.97(\%Co)-1.15(\%Ti)-1.21(\%Si+\%Cr)+9.35(\%C) \text{ at least } 43.6.$$

6. An alloy in accordance with either claims 1 or 3 proportioned to provide that relationship A is at most 49.2 and relationship B is at least 47.4.

7. An alloy in accordance with claim 1 which contains about 0.3% to about 0.7% silicon.

* * * * *